US010323312B2

(12) United States Patent
Glavicic

(10) Patent No.: US 10,323,312 B2
(45) Date of Patent: Jun. 18, 2019

(54) REDUCING MICROTEXTURE IN TITANIUM ALLOYS

(71) Applicant: Rolls-Royce Corporation, Indianapolis, IN (US)

(72) Inventor: Michael George Glavicic, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 505 days.

(21) Appl. No.: 14/964,180

(22) Filed: Dec. 9, 2015

(65) Prior Publication Data

US 2016/0168680 A1 Jun. 16, 2016

Related U.S. Application Data

(60) Provisional application No. 62/090,119, filed on Dec. 10, 2014.

(51) Int. Cl.

| | |
|---|---|
| ***C22F 1/18*** | (2006.01) |
| ***C22F 1/00*** | (2006.01) |
| ***C22C 14/00*** | (2006.01) |

(52) U.S. Cl.

CPC ..... *C22F 1/183* (2013.01); *C22C 14/00* (2013.01); *C22F 1/002* (2013.01)

(58) Field of Classification Search

CPC ..... C22C 14/00; C22F 1/002; C22F 1/183

See application file for complete search history.

(56) References Cited

U.S. PATENT DOCUMENTS 3,901,743 A * 8/1975 Sprague ..... C22F 1/183 148/407

5,232,525 A 8/1993 Smith et al.

(Continued)

FOREIGN PATENT DOCUMENTS

CN 101429637 A * 5/2009

OTHER PUBLICATIONS

Effect of Single and Duplex Stage Heat Treatment on the Microstructure and Mechanical Properties of Cast Ti—6Al—4V Alloy (Year: 2013).*

(Continued)

*Primary Examiner* — Jenny R Wu

(74) *Attorney, Agent, or Firm* — Shumaker & Sieffert, P.A.

(57) ABSTRACT

A method includes heating an initial titanium alloy comprising a duplex microstructure at a first solution temperature that is below a phase transition temperature of the alloy. Substantially all secondary alpha phase domains may dissolve during the heating. The method also includes cooling the initial titanium alloy at a first cooling rate to form a recrystallized annealed titanium alloy comprising primary alpha phase domains. The method further includes heating the recrystallized annealed titanium alloy to a second solution temperature that is below the phase transition temperature of the alloy. The method additionally includes cooling the recrystallized annealed titanium alloy at a second cooling rate to form a treated titanium alloy comprising the duplex microstructure. The second cooling rate is different than the first cooling rate. A distribution of crystallographic orientations of primary alpha phase domains in the treated titanium alloy may be different than in the initial titanium alloy.

12 Claims, 1 Drawing Sheet

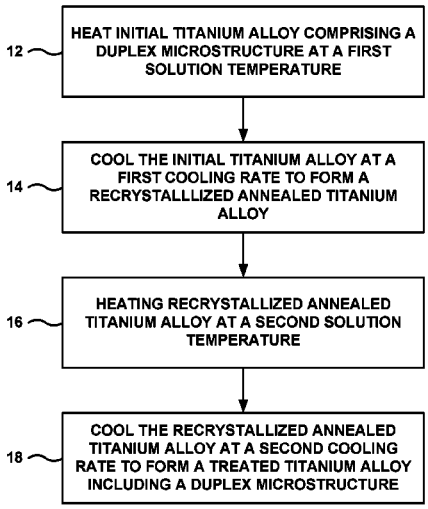

(56) References Cited

U.S. PATENT DOCUMENTS

| | | | |
|---|---|---|---|
| 6,589,371 | B1 | 7/2003 | Kaibyshev et al. |
| 7,785,429 | B2 | 8/2010 | Briggs |
| 7,892,369 | B2 | 2/2011 | Bhambri |
| 8,262,819 | B2 | 9/2012 | Briggs |
| 8,500,929 | B2 | 8/2013 | Cotton et al. |
| 2013/0037183 | A1 | 2/2013 | Daffos et al. |
| 2014/0014242 | A1 | 1/2014 | Emura et al. |

OTHER PUBLICATIONS

Microstructure Evolution during Alpha-Beta Heat Treatment of Ti—6Al—4V (Year: 2003).*

* cited by examiner

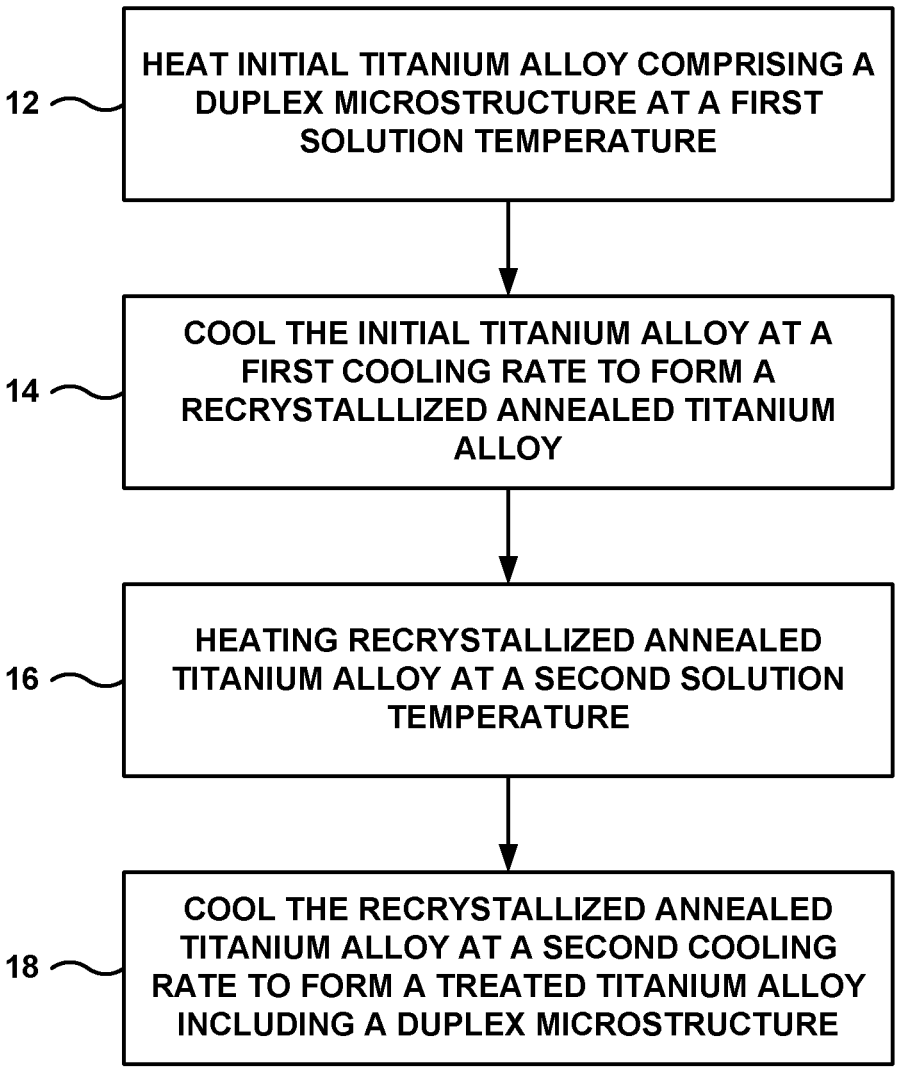
12
HEAT INITIAL TITANIUM ALLOY COMPRISING A DUPLEX MICROSTRUCTURE AT A FIRST SOLUTION TEMPERATURE
14
COOL THE INITIAL TITANIUM ALLOY AT A FIRST COOLING RATE TO FORM A RECRYSTALLLIZED ANNEALED TITANIUM ALLOY
16
HEATING RECRYSTALLIZED ANNEALED TITANIUM ALLOY AT A SECOND SOLUTION TEMPERATURE
18
COOL THE RECRYSTALLIZED ANNEALED TITANIUM ALLOY AT A SECOND COOLING RATE TO FORM A TREATED TITANIUM ALLOY INCLUDING A DUPLEX MICROSTRUCTURE

REDUCING MICROTEXTURE IN TITANIUM ALLOYS

This application claims the benefit of U.S. Provisional Application No. 62/090,119, filed Dec. 10, 2014, which is incorporated by reference in its entirety.

TECHNICAL FIELD

The disclosure relates to titanium alloys, and more particularly, methods of reducing microtexture in titanium alloys.

BACKGROUND

Microtexture is a phenomenon in which relatively large, localized regions of a certain material phase have a substantially common crystallographic orientation. Regions of microtexture that exceed a threshold size in at least one dimension are presently believed to be a cause of dwell fatigue in some titanium alloys.

SUMMARY

The disclosure describes techniques for forming titanium alloys including reduced microtexture. Microtexture is a phenomenon in which relatively large, localized regions of a certain material phase have a substantially common crystallographic orientation (e.g., a substantially similar orientation of crystal unit cells). In some examples, the titanium alloys may include a duplex microstructure including first phase domains and second phase domains. Titanium alloys with reduced microtexture may exhibit less anisotropic mechanical properties than titanium alloys with greater amounts of microtexture, may be less susceptible to cold dwell fatigue, or both. In some examples, the techniques described herein may be applied to black forgings or billet stock material prior to any machining processes.

In some examples, the disclosure describes a method including heating an initial titanium alloy comprising a duplex microstructure including a first volume fraction of primary alpha phase domains and a second volume fraction of secondary alpha phase domains at a first solution temperature. The first solution temperature may be below a phase transition temperature of the initial titanium alloy, and substantially all of the secondary alpha phase domains may dissolve during the heating. The method also may include cooling the initial titanium alloy at a first cooling rate to form a recrystallized annealed titanium alloy comprising primary alpha phase domains. The method further may include heating the recrystallized annealed titanium alloy at a second solution temperature. The second solution temperature may be below the phase transition temperature of the recrystallized annealed titanium alloy. The method additionally may include cooling the recrystallized annealed titanium alloy at a second cooling rate to form a treated titanium alloy comprising the duplex microstructure comprising a third volume fraction of primary alpha phase domains and a fourth volume fraction of secondary alpha phase domains. The second cooling rate may be different than the first cooling rate, and a distribution of crystallographic orientations of the primary alpha phase domains in the treated titanium alloy may be different than a distribution of crystallographic orientations of the primary alpha phase domains in the initial titanium alloy.

In some examples, the disclosure describes a titanium alloy including a plurality of primary alpha phase domains, where each respective primary alpha phase domain of the plurality of primary alpha phase domains comprises a respective crystallographic orientation, and wherein the respective crystallographic orientations are substantially randomly oriented. The titanium alloy also includes a plurality of secondary alpha phase domains.

The details of one or more examples are set forth in the accompanying drawings and the description below. Other features, objects, and advantages will be apparent from the description and drawings, and from the claims.

BRIEF DESCRIPTION OF DRAWINGS

FIG. 1 is a flow diagram illustrating an example technique for heat treating a titanium alloy component in accordance with one or more examples of this disclosure.

DETAILED DESCRIPTION

The disclosure describes techniques for forming titanium alloys including reduced microtexture. Microtexture is a phenomenon in which relatively large, localized regions of a certain material phase have a substantially common crystallographic orientation (e.g., a substantially similar orientation of crystal unit cells). In some examples, the titanium alloys may include a duplex microstructure including first phase domains and second phase domains. Titanium alloys with reduced microtexture may exhibit less anisotropic mechanical properties than titanium alloys with greater amounts of microtexture, may be less susceptible to cold dwell fatigue, or both. In some examples, the techniques described herein may be applied to black forgings or billet stock material prior to any machining processes.

Titanium alloys for use in high temperature mechanical systems, such as gas turbine engines, may possess a duplex microstructure including primary alpha phase domains and secondary alpha phase domains. Titanium alloys including the duplex microstructure exhibit desirable mechanical properties for use in high temperature systems, including, for example, improved strength, fracture toughness, fatigue performance, or the like, compared to titanium alloys including a beta microstructure.

In some examples, the techniques used to form titanium alloys including a duplex microstructure may result in regions of microtexture being present in the titanium alloy. For example, in some rolled titanium alloy components, a majority of primary alpha phase domains may have their basal poles (or c-axes) oriented in the rolling direction of the component, while a minority of primary alpha phase domains may have their basal poles (or c-axes) oriented in the transverse direction, substantially perpendicular to the rolling direction. In some examples, about 80% of primary alpha phase domains may have their basal poles (or c-axes) oriented in the rolling direction of the component, while about 20% of primary alpha phase domains may have their basal poles (or c-axes) oriented in the transverse direction. This increases the probability of large regions of commonly oriented regions of primary alpha phase domains, which may increase the probability of the titanium alloy including one or more region of microtexture that exceeds a threshold size.

Likewise, this increase in the probability of the titanium alloy including one or more region of microtexture that exceeds a threshold size may increase the probability of the titanium alloy having increased susceptibility to dwell fatigue. In dwell fatigue, subsurface cracks initiate and propagate within the volume of the titanium alloy and may not be detectable using common inspection techniques. These subsurface cracks may lead to catastrophic failure of the titanium alloy.

In accordance with some examples of this disclosure, a heat treatment technique may be used to reform a duplex microstructure while reducing alignment of basal poles (or c-axes) of primary alpha phase domains, thus reducing a size of one or more regions of microtexture in a titanium alloy. Reducing the size of one or more regions of microtexture in the titanium alloy may reduce susceptibility of the titanium alloy to dwell fatigue.

FIG. 1 is a flow diagram illustrating an example technique for heat treating a titanium alloy component in accordance with one or more examples of this disclosure. The technique of FIG. 1 includes heating an initial titanium alloy comprising a duplex microstructure including a first volume fraction of primary alpha phase domains and a second volume fraction of secondary alpha phase domains at a first solution temperature (12). The initial titanium alloy may include any titanium alloy that may be processed to result in formation of a duplex microstructure. For example, the initial titanium alloy may include, Ti-6Al-V (about 6 wt. % Al and about 4 wt. % V) Ti-6242 (about 6 wt. % Al, about 2 wt. % Sn, about 4 wt. % Zr, about 2 wt. % Mo, and a balance Ti and impurities) or Ti-6246 (about 6 wt. % Al, about 2 wt. % Sn, about 4 wt. % Zr, about 6 wt. % Mo, and a balance Ti and impurities). As used herein, the word "about," when modifying a listed composition or composition range, denotes a range of ±0.5 wt. %.

The initial titanium alloy may include primary alpha phase domains and secondary alpha phase domains. In some examples, the primary alpha phase domains may be substantially spherical, and the secondary alpha phase domains may be lenticular shaped. The duplex microstructure may provide desirable mechanical properties to the initial titanium alloy, including, for example, at least one of improved strength, improved fracture toughness, or improved fatigue performance compared to a titanium alloy including beta phase. In some examples, a titanium alloy including a duplex microstructure may have mechanical properties that approach those of nickel-based alloys, while being less dense.

As described above, some titanium alloys including a duplex microstructure may include microtexture zones, e.g., due to the processing used to form the titanium alloy. For example, some titanium alloy components formed by rolling may include a majority of primary alpha phase domains that have their basal poles (or c-axes) oriented in the rolling direction of the component and a minority of primary alpha phase domains that have their basal poles (or c-axes) oriented in the transverse direction, substantially perpendicular to the rolling direction. A zone in which many primary alpha phase domains have their basal poles (or c-axes) oriented in substantially a single direction may result in the zone being susceptible to cold dwell fatigue. Cold dwell fatigue may be problematic, because the cracks may form in an interior of the titanium alloy, may be difficult to detect using conventional inspection techniques, and may lead to catastrophic failure of the alloy.

Heating the initial titanium alloy comprising the duplex microstructure including the first volume fraction of primary alpha phase domains and the second volume fraction of secondary alpha phase domains at the first solution temperature (12) may include heating the initial titanium alloy at a solution temperature that is below a phase transition temperature of the initial titanium alloy. In some examples, the phase transition temperature may be a beta transus transition temperature of the initial titanium alloy. The first solution temperature may be may be between about 30° C. and about 50° C. below the beta transus transition temperature of the initial titanium alloy in some implementations. In other implementations, the first solution temperature may be less than 30° C. below the beta transus transition temperature. The time for which the initial titanium alloy is heated may be selected so that substantially all (e.g., all or nearly all) of the secondary alpha phase may dissolve and form beta phase. In some examples, at least some of the primary alpha phase may dissolve and form beta phase. In other examples, substantially all (e.g., all or nearly all) of the primary alpha phase may remain undissolved. The amount, if any, of the primary alpha phase dissolved while heating the initial titanium alloy at the first solution temperature (12) may depend on the alloy chemistry and the first solution temperature. For example, if the first solution temperature is above the solution temperature used to generate the initial duplex microstructure, at least some of the primary alpha phase domains will dissolve. The initial titanium alloy may be heated in a furnace and, in some examples, may be in an atmosphere that is substantially inert to the initial titanium alloy.

Once substantially all of the secondary alpha phase has dissolved and formed beta phase, the initial titanium alloy may be cooled at a first cooling rate to form a recrystallized annealed titanium alloy comprising primary alpha phase domains (14). In some implementations, the recrystallized annealed titanium alloy may include only primary alpha phase domains, and may not include secondary alpha phase domains. In some examples, cooling the initial titanium alloy at a first cooling rate to form the recrystallized annealed titanium alloy (14) includes turning off a furnace in which the initial titanium alloy was heated and allowing the initial titanium alloy to cool in the furnace. The cooling rate may depend on factors including the alloy chemistry, workpiece size, and the like.

During the cooling process, primary alpha phase may grow from beta phase or existing primary alpha phase. The growth of primary alpha phase during the cooling process may result in a plurality of primary alpha phase domains. Although not wishing to be bound by any theory, it is currently believed that primary alpha phase domains (or grains) that are not crystallographically coherent with prior beta phase have a higher propensity to grow during the slow cooling process. Again, while not wishing to be bound by any theory, it is currently believed that this propensity to grow may be due to incompatibilities in the stacking arrangements of the atoms across the alpha-beta interface surrounding a primary alpha phase domain at elevated temperatures. This may effectively translate to a higher grain boundary energy or driving force for growth of the primary alpha phase domains that are not crystallographically coherent with prior beta phase. As a result, these non-crystallographically coherent primary alpha phase domains may grow faster than crystallographically coherent primary alpha phase domains.

Due to the potential difference in growth rates, in the recrystallized annealed titanium alloy (after cooling), the basal poles of the respective primary alpha phase domains may be more randomly distributed (e.g., compared to basal poles in a rolled titanium alloy, in which a majority of the basal poles are oriented generally parallel to the rolling direction). For example, the basal poles of the respective primary alpha phase domains may be substantially randomly oriented (e.g., randomly oriented or nearly randomly oriented) within three dimensions of the recrystallized annealed titanium alloy. In some examples, about half of the basal poles may be generally oriented in a first direction (e.g., the rolling direction with reference to the initial titanium alloy) and about half of the basal poles may be generally oriented in a second direction (e.g., the transverse direction with reference to the initial titanium alloy), substantially perpendicular to the first general direction. The reorientation of the basal poles reduces the size of regions or zones of microtexture in the titanium alloy.

Although this first heating and cooling technique results in more even distribution of the orientation of basal poles of the respective primary alpha phase domains, this first heating and cooling technique also results in the microstructure of the recrystallized annealed titanium alloy not being a duplex microstructure, as the secondary alpha phase was substantially dissolved during the heating and does not substantially regrow during the slow cooling. Thus, the technique of FIG. 1 includes additional processing steps to reform the desired duplex microstructure.

For example, the technique of FIG. 1 includes heating the recrystallized annealed titanium alloy at a second solution temperature (16). Similar to the first solution temperature described above, the phase transition temperature may be a beta transus transition temperature of the recrystallized annealed titanium alloy. The second solution temperature may be between about 30° C. and about 50° C. below the beta transus transition temperature of the recrystallized annealed titanium alloy in some implementations. In other implementations, the second solution temperature may be less than 30° C. below the beta transus transition temperature. The recrystallized annealed alloy may be heated in a furnace and, in some examples, may be in an atmosphere that is substantially inert to the titanium alloy.

The technique of FIG. 1 further may include cooling the recrystallized annealed alloy at a second cooling rate to form a treated titanium alloy including the duplex microstructure that includes primary alpha phase domains and secondary alpha phase domains (18). The second cooling rate is different than the first cooling rate. The second cooling rate may be greater than the first cooling rate or less than the first cooling rate. In some examples, cooling the recrystallized annealed titanium alloy at the second cooling rate (18) includes quenching the recrystallized annealed titanium alloy in a cooling medium, such as water, an oil, or the like.

The second cooling rate may allow formation of secondary alpha phase domains, resulting in formation of a duplex microstructure. In some examples, temperature at which and time for which the recrystallized annealed alloy is heated and the cooling rate may be controlled such that the volume fraction of primary alpha phase domains in the initial titanium alloy and the volume fraction of primary alpha phase domains in the treated titanium alloy are substantially equal. Additionally, in some examples, an average size of the primary alpha phase domains in the treated titanium alloy is substantially the same as an average size of the primary alpha phase domains in the initial titanium alloy.

In some examples, temperature at which and time for which the recrystallized annealed alloy is heated and the cooling rate may be controlled such that an average width of the secondary alpha phase domains in the treated titanium alloy is substantially the same as an average width of the secondary alpha phase domains in the initial titanium alloy. By having these properties of the primary alpha phase domains and the secondary alpha phase domains be substantially similar in the initial titanium alloy and the treated titanium alloy, some of the resulting mechanical properties of the alloy may be substantially similar.

Although not wishing to be bound by theory, thermodynamics and chemical segregation rates may dominate local kinetics for conversion of phases during heating the recrystallized annealed titanium alloy at the second solution temperature (16). This may result in the treated titanium alloy having a distribution of crystallographic orientations of the primary alpha phase domains in the treated titanium alloy is different than a distribution of crystallographic orientations of the primary alpha phase domains in the initial titanium alloy. In other words, the treated alloy may have primary alpha phase domains with more randomly oriented basal poles (e.g., as described for the recrystallized annealed titanium alloy) than the initial titanium alloy. Because the basal poles of the primary alpha phase domains may be more randomly oriented, there may be a lower probability that the treated titanium alloy has microtexture zones, and thus, a lower probability that the treated titanium alloy has zones susceptible to dwell fatigue.

The techniques described herein may utilize only heat treatment steps to break up zones of microtexture, rather than using thermomechanical techniques. Using only heat treatments steps may be less expensive and simpler than using thermomechanical techniques.

Various examples have been described. These and other examples are within the scope of the following claims.

The invention claimed is:

1. A method comprising:

heating, at a first solution temperature, an initial titanium alloy comprising a duplex microstructure comprising primary alpha phase domains and secondary alpha phase domains, wherein the duplex microstructure includes a first volume fraction of primary alpha phase domains and a second volume fraction of secondary alpha phase domains, wherein the first solution temperature is below a phase transition temperature of the initial titanium alloy, and wherein substantially all of the secondary alpha phase domains dissolve during the heating at the first solution temperature;

cooling the initial titanium alloy at a first cooling rate to form a recrystallized annealed titanium alloy comprising substantially only primary alpha phase domains;

heating the recrystallized annealed titanium alloy at a second solution temperature, wherein the second solution temperature is below the phase transition temperature of the recrystallized annealed titanium alloy; and cooling the recrystallized annealed titanium alloy at a second cooling rate to form a treated titanium alloy comprising the duplex microstructure comprising primary alpha phase domains and secondary alpha phase domains, wherein the treated titanium alloy comprises a third volume fraction of primary alpha phase domains and a fourth volume fraction of secondary alpha phase domains, wherein the second cooling rate is different than the first cooling rate, and wherein a distribution of crystallographic orientations of the primary alpha phase domains in the treated titanium alloy is different than a distribution of crystallographic orientations of the primary alpha phase domains in the initial titanium alloy.

2. The method of claim 1, wherein the first volume fraction and the third volume fraction are different.

3. The method of claim 1 wherein an average size of the primary alpha phase domains in the treated titanium alloy is different than an average size of the primary alpha phase domains in the initial titanium alloy.

4. The method of claim 1, wherein an average width of the secondary alpha phase domains in the treated titanium alloy is different than an average width of the secondary alpha phase domains in the initial titanium alloy.

5. The method of claim 1, wherein the phase transition temperature comprises a beta transus transition temperature.

6. The method of claim 5, wherein the first solution temperature and the second solution temperature are between about 30° C. and about 50° C. below the beta transus transition temperature.

7. The method of claim 1, wherein cooling the initial titanium alloy at a first cooling rate to form the recrystallized annealed titanium alloy comprising substantially only primary alpha phase domains comprises turning off a furnace in which the initial titanium alloy was heated and allowing the initial titanium alloy to cool in the furnace.

8. The method of claim 1, wherein cooling the recrystallized annealed titanium alloy at the second cooling rate comprises quenching the recrystallized annealed titanium alloy in a cooling medium.

9. The method of claim 8, wherein the cooling medium comprises water.

10. The method of claim 1, wherein an average microtexture region volume in the initial alloy is larger than an average microtexture region volume in the treated alloy.

11. The method of claim 1, wherein the first cooling rate is greater than the second cooling rate.

12. The method of claim 1, wherein the second cooling rate is greater than the first cooling rate.

* * * * *